US006026627A

United States Patent [19]

Moore

[11] Patent Number: 6,026,627

[45] **Date of Patent: *Feb. 22, 2000**

[54] ANTENNA SUPPORT FOR POWER TRANSMISSION TOWER

[75] Inventor: Roy J. Moore, Arlington, Tex.

[73] Assignee: FWT, Inc., Fort Worth, Tex.

[ * ] Notice: This patent is subject to a terminal disclaimer.

[21] Appl. No.: 09/225,078

[22] Filed: Jan. 4, 1999

Related U.S. Application Data

[63] Continuation of application No. 08/877,717, Jun. 23, 1997, Pat. No. 5,855,103, which is a continuation of application No. 08/522,976, Sep. 1, 1995, Pat. No. 5,649,402.

[51] Int. Cl.[7] ..... E04H 12/10; E04G 21/00

[52] U.S. Cl. ..... 52/651.02; 52/40; 52/223.4; 52/297; 52/651.03; 52/736.2; 52/745.17; 343/890

[58] Field of Search ..... 52/40, 223.3, 223.5, 52/296, 297, 651.01, 651.02, 651.03, 651.07, 736.1, 736.2, 745.17, 745.18; 343/878, 890

[56] References Cited

U.S. PATENT DOCUMENTS

| | | | |
|---|---|---|---|
| 1,705,104 | 3/1929 | Woodruff et al. | 52/651.02 |
| 1,963,014 | 6/1934 | Brown | 52/651.07 X |
| 2,198,955 | 4/1940 | Taylor | 52/651.02 |
| 2,237,936 | 4/1941 | Jackson | 52/651.07 X |
| 2,510,059 | 6/1950 | Black | 52/40 |
| 2,521,550 | 9/1950 | Smith . | |
| 2,804,950 | 9/1957 | Leslie, Jr. | 52/117 |
| 3,062,336 | 11/1962 | Baxter | 52/223.4 |
| 3,254,343 | 5/1966 | Laub et al. | 343/890 |
| 3,358,952 | 12/1967 | Burns . | |
| 4,145,696 | 3/1979 | Gueguen | 343/890 X |
| 4,342,474 | 8/1982 | Sewell et al. | 52/40 X |
| 5,097,647 | 3/1992 | Sopik et al. | 52/651.07 |
| 5,212,912 | 5/1993 | Foissac | 52/40 |
| 5,581,962 | 12/1996 | Davis et al. | 52/148 |
| 5,649,402 | 7/1997 | Moore | 52/651.02 |
| 5,855,103 | 1/1999 | Moore | 52/651.02 |

*Primary Examiner*—Carl Friedman
*Assistant Examiner*—Timothy B. Kang
*Attorney, Agent, or Firm*—Felsman, Bradley, Vaden, Gunter & Dillon, LLP; James E. Bradley

[57] ABSTRACT

An electrical powered transmission tower is modified to also support a telecommunications antenna. The tower has a plurality of legs interconnected by lattice braces. A support column is erected within the enclosure of the tower. The support column has a base anchored in the ground on a concrete foundation. The column extends upward through the tower and protrudes through the top. The antenna is mounted to the upper end of the column. Fasteners secure the column to the tower for lateral support.

13 Claims, 3 Drawing Sheets

ANTENNA SUPPORT FOR POWER TRANSMISSION TOWER

This application is a continuation application of application Ser. No. 08/877,717, filed Jun. 23, 1997, which will issue as U.S. Pat. No. 5,855,103 on Jan. 5, 1999, which was a continuation of Ser. No. 08/522,976 filed Sep. 1, 1995, U.S. Pat. No. 5,649,402.

BACKGROUND OF THE INVENTION

1. Field of the Invention

This invention relates in general to telecommunication towers and in particular to a support for mounting an antenna to an electrical power utility tower.

2. Description of the Prior Art

The growing popularity of cellular telephones has greatly increased the need for towers for transmitting and receiving antennas. Communication towers normally are special purpose structures supported by guide wires or by tapered legs. In the new cellular phone telephone market, the towers do not have to be extremely high, nevertheless, construction is a problem. New towers will be needed in densely populated areas, often only one to five miles apart from each other. A new tower requires an extensive permit process and often zoning changes. Residential neighborhoods do not want such towers in their neighborhoods even if they are not very high.

Electrical power distribution towers have long been present. The towers which are used to carry high voltage are normally made of steel and have four or more legs connected by lattice braces. These towers have heights which typically run 80 to 105 feet, thus would be adequately high enough for mounting a communication antenna. Also, the towers have adequate lateral strength to resist bending and excessive swaying due to the weight of the wires and wind. However, the towers are normally built to a very close specification as to compressive loads. Typically the tower will be designed to handle only the requisite load and will collapse if any appreciable weight is added. An antenna assembly would typically weight about 1500 pounds. This amount would often exceed the rating of the tower for compressive loads.

SUMMARY OF THE INVENTION

In this invention, existing electrical power transmission towers are retrofitted to be able to accommodate an antenna assembly. The utility towers have four legs anchored in the ground and are interconnected by lattice braces. At least one crossarm extends transversely from the legs supporting electrical power wires extending between adjacent towers.

A support column is erected within the confines of the structure defined by the four legs and lattice braces. The support column has a base which is anchored in the ground. It extends upward through the tower with the upper end protruding above an upper end of the tower. The antenna assembly is mounted to the upper end of the column. Fasteners secure the column to the tower for lateral support. The fasteners do not transfer to the tower any downward force on the column due to weight. In the preferred embodiment, the column comprises a plurality of pipe sections secured to one another. In another embodiment, the column comprises a plurality of legs interconnected by lattice braces.

DETAILED DESCRIPTION OF THE INVENTION

Figure 1A:
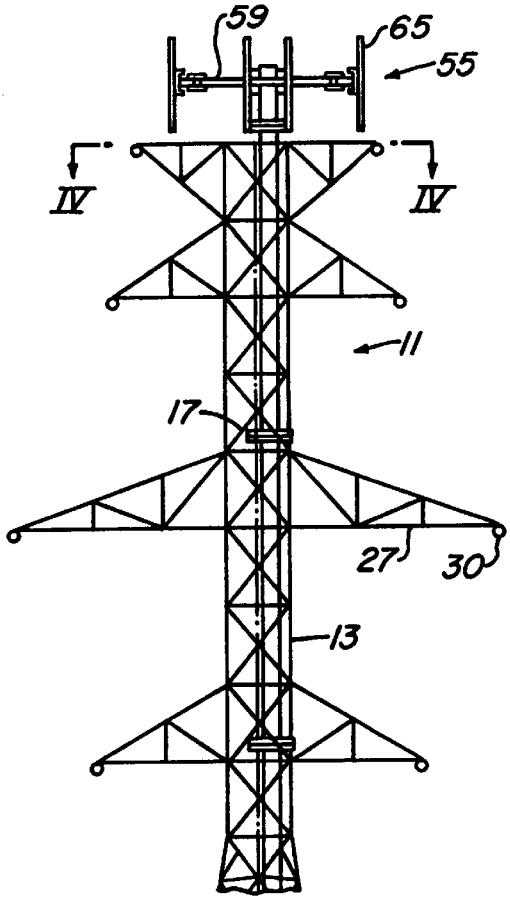
FIGS. 1A and 1B make up an elevational view of a utility tower having a telecommunication antenna assembly mounted in accordance to this invention.
Figure 1B:
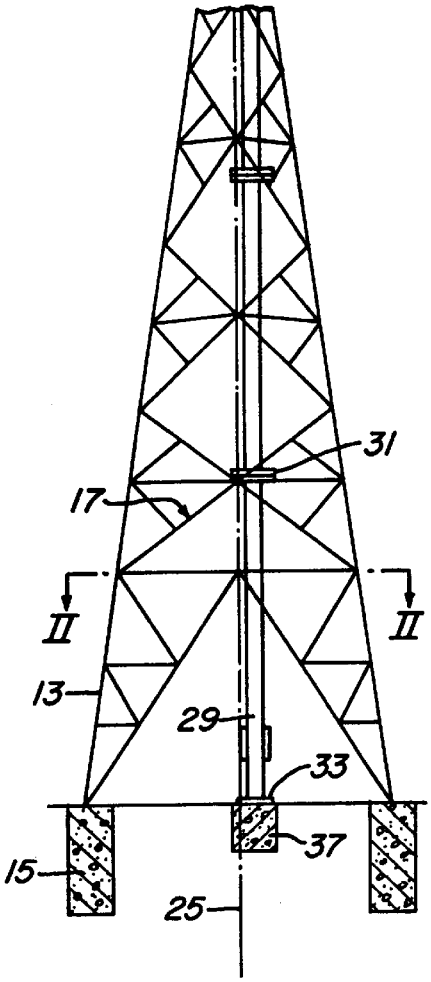
Figure 2:
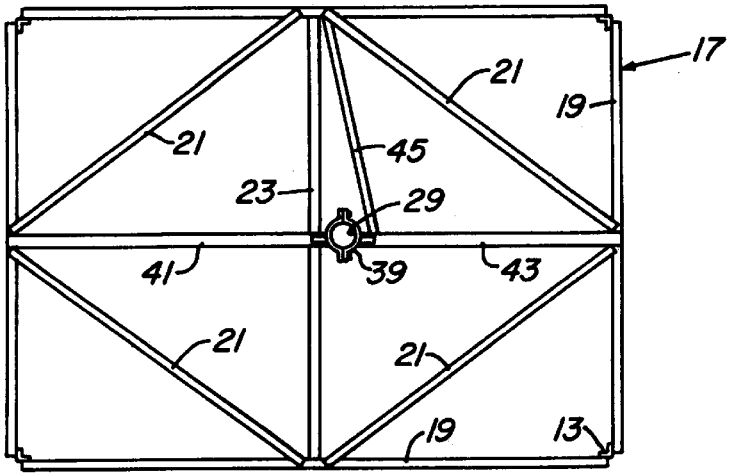
FIG. 2 is a sectional view of the tower of FIGS. 1A and 1B, taken along the line II—II of FIG. 1B.
Figure 3:
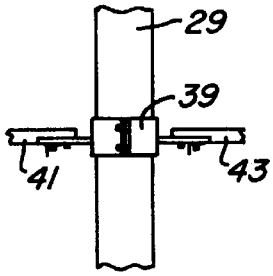
FIG. 3 is a partial elevational view of a portion of the support column for the tower of FIGS. 1A and 1B.

Referring to FIGS. 1A and 1B, tower 11 exemplifies a utility electrical power distribution structure. Tower 11 has four legs 13 which define a rectangular space, as shown in FIG. 2. Legs 13 in the embodiment shown diverge toward each other, tapering until reaching an upper portion, which is shown in FIG. 1A. Legs 13 extend parallel to each other in the upper portion. In other types of towers, the legs 13 may continue to converge to the top. As shown in FIG. 1B, each leg 13 is supported by a concrete foundation 15, which is located in the ground or earth. Legs 13 are metal and interconnected with a plurality of lattice braces 17.

Referring to FIG. 2, some of the lattice braces 17 are exterior braces 19 which form a diamond shape pattern as they lace legs 13 together. In addition, interior diagonal braces 21 connect at various points along the legs 13. The interior diagonal braces 21 in the embodiment shown are diagonal across each corner formed by the one of the legs 13. Also, its common to have at least one interior median brace 23 which extends from one side of tower 11 to the other. In this embodiment, the legs 13 do not define a square, rather legs 13 define a rectangle with one side longer than the other. Median brace 23 connects the two longer sides together. The pattern of interior bracing as shown in FIG. 2 will be located at several points along the length of the tower 11.

Figure 4:
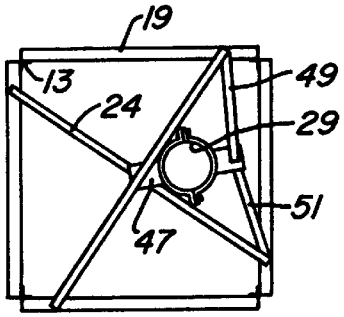
FIG. 4 is a sectional view of the tower of FIGS. 1A and 1B, taken along the line IV—IV of FIG. 1A.

Referring to FIG. 4, the pattern of bracing differs somewhat in the upper portion of tower 11. In this area, two diagonal braces 24 extend within the interior, interconnecting the exterior braces 19. Braces 24 intersect each other at about 90 degrees. However, the ends of the braces 24 do not connect to the legs 13, rather are offset and connect to exterior braces 19 a short distance from the legs 13. The longitudinal axis 25 (FIG. 1B) is equidistant between opposite sides of exterior braces 19, and passes through median base 23 and through the intersection of interior braces 24 (FIG. 4).

Tower 11 also has a number of crossarms 27. Crossarms 27 extend perpendicular to axis 25 and outward from legs 13. Crossarms 27 each comprise a truss to provide support for wires 28, connected by insulators 30, shown in FIG. 11.

Wires 28 are used for distributing high voltage electrical power, often over great distances. Typically, the towers 11 will be spaced a few hundred feet apart from each other.

Figure 7:
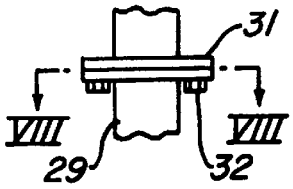
FIG. 7 is a partial sectional view illustrating a flange connection between two of the pipes for the support column of FIGS. 1A and 1B.
Figure 8:
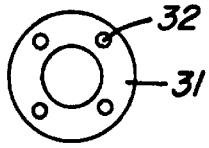
FIG. 8 is a sectional view of the support column of FIG. 7, taken along the line VIII—VIII of FIG. 7.
Figure 11:
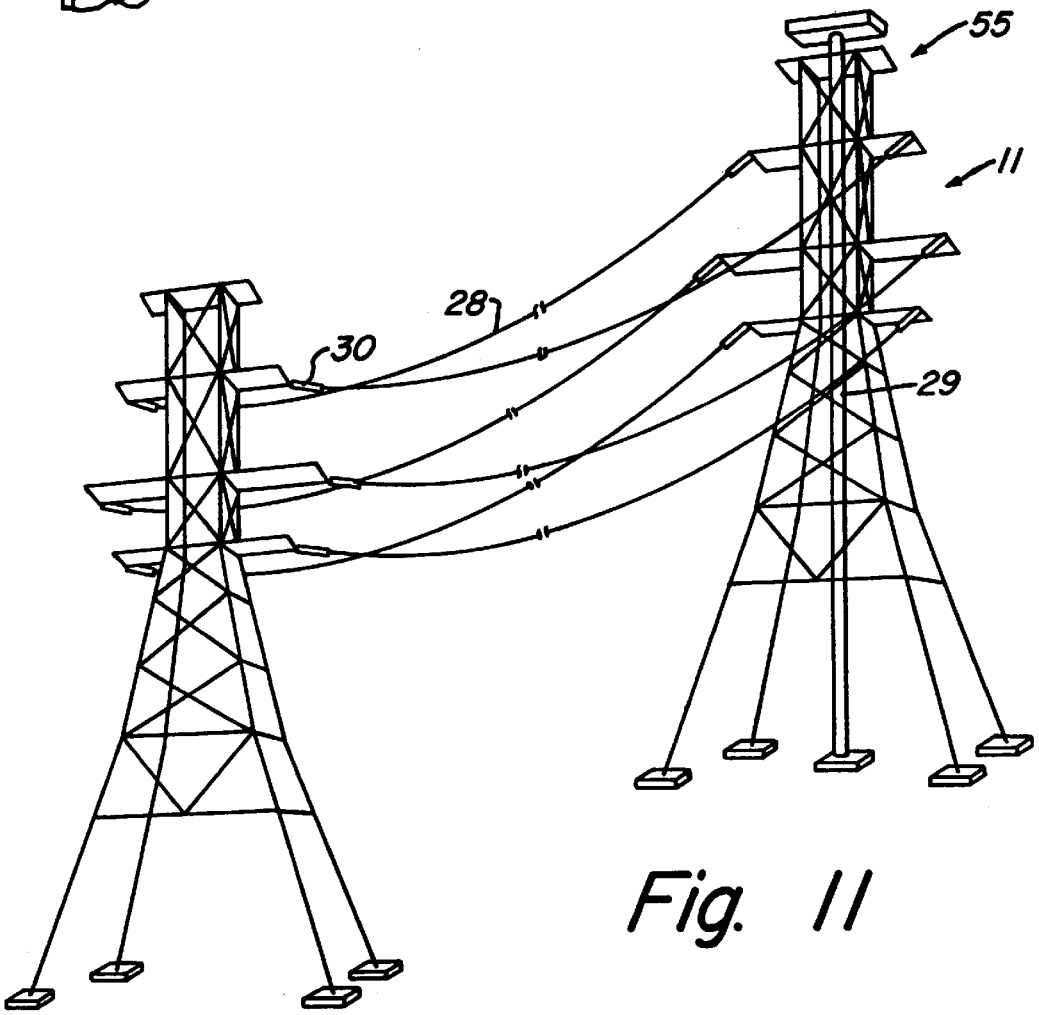
FIG. 11 is a perspective view illustrating two utility towers, one of them being modified to have a support column and an antenna assembly constructed in accordance with this invention.

As shown in FIG. 11 and FIGS. 1A and B, one of the towers 11 has been modified with the installation of a support column 29. Column 29 in the first embodiment is made up of sections of steel pipe, preferably about 10¾ inches in diameter. The length of each section of column 29 may be 5 to 20 feet, with each pipe being connected as shown in FIG. 7. External flanges 31 welded to the ends of each pipe abut each other and are interconnected by bolts 32.

Figure 6:
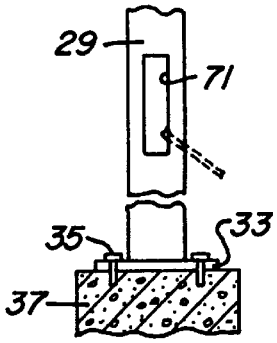
FIG. 6 is a partial sectional view of the base of the support column for the tower of FIGS. 1A and 1B.

Referring to FIG. 6, column 29 is independently supported from tower 11 for receiving compressive loads. Column 29 has a base 33 which comprises a flange, with base 33 resting on a concrete foundation 37 located in the ground. Bolts 35 secure base 33 to foundation 37.

While all compressive loading on column 29 passes to foundation 37, lateral support is provided by tower 11. As shown in FIG. 2, fastening means connect column 29 to tower 11 at various points along the length of tower 11. These fasteners include a collar 39. Collar 39 is a clamp which fits about column 29. Collar 39 is connected to two of the exterior lattice braces 19 by two tie braces 41, 43. Tie braces 41, 43 extend through longitudinal axis 25 and are secured to interior median brace 23. Tie braces 41, 43 are parallel to the longer sides of tower 11 and perpendicular to the shorter side. Tie braces 41, 43 equally bisect the shorter sides of tower 11. Additionally, a tie brace 45 is secured between tie brace 43 and one of the exterior braces 19. Tie brace 45 extends at an acute angle relative to median brace 23 and is connected to substantially the same point of an exterior brace 19 along one of the longer sides. Tie braces 41, 43 and 45 provide lateral support to column 39, preventing it from swaying or bending due to wind.

As shown in FIG. 4, in the upper portion of tower 11, tie braces 47, 49 and 51 secure column 29 against lateral movement. Tie brace 47 connects to the interior braces 24 at the intersection of interior braces 24 with each other. Tie braces 49, 51 connect the collar 39 to two of the exterior braces 19. All of the tie braces 41, 43, 45, 47, 49 and 51 are contained in horizontal planes perpendicular to longitudinal axis 25. There is no path through which any downward force on column 29 can pass through any of the tie braces to the tower 11 because of the horizontal orientation of the tie braces. The tie braces are thin metal strips, and while they provide adequate lateral strength, would not transfer the weight of the column 29 to the tower 11. Column 29 has an axis which is offset from and parallel to longitudinal axis 25.

Figure 5:
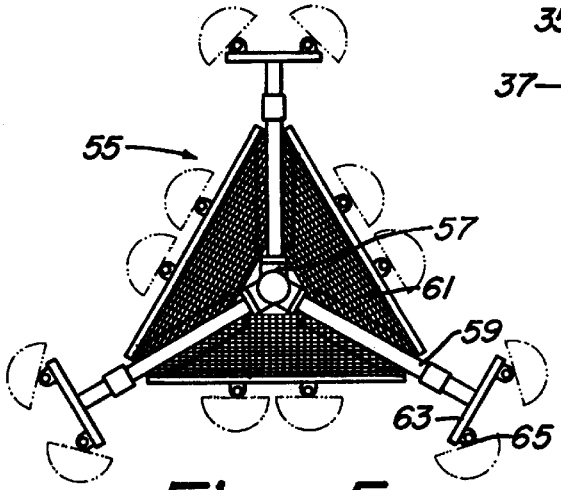
FIG. 5 is a plan view of the antenna assembly for the tower of FIGS. 1A and 1B.
Figure 9:
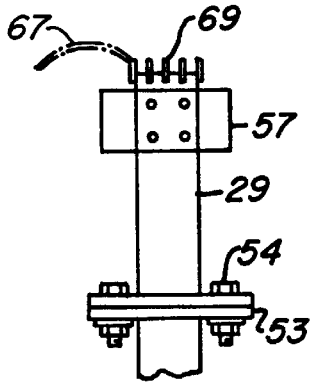
FIG. 9 is a partial sectional view of the upper end of the support column of FIGS. 1A and 1B.

The upper end of column 29 protrudes above the upper end of tower 11 a short distance. As shown in FIG. 9, the upper end of column 29 has a flange connection 53 that is secured by bolts 54. The holes (not shown) in one of the mating flanges 53 are elongated so as to allow flanges 53 to be rotated relative to each other to a selected orientation. An antenna assembly 55 mounts to the upper end of the short joint of column 29 located above flange 53. Antenna assembly 55 is conventional and may be of various types. Referring to FIG. 5, antenna assembly 55 includes a hub 57. Hub 57 fits on the upper end of column 29. Hub 57 supports three spokes 59 which extend outward 120 degrees apart from each other. A grid 61 interconnects the spokes 59. Brackets 63 are mounted to each of the spokes 59. Antennas 65, shown schematically by dotted lines, are mounted to the brackets 63.

As shown in FIG. 9, waveguides or wires 67 from the various antennas 65 (FIG. 5) are supported by conventional supports 69 at the upper end of column 29. Column 29 is completely hollow, with each of the flanges 53 and 31 having holes through them. Wires 67 extend downward through the column and exit a waveguide port 71 (FIG. 6). Wires 67 lead to transmitter and receiver equipment on the ground.

Figure 10:
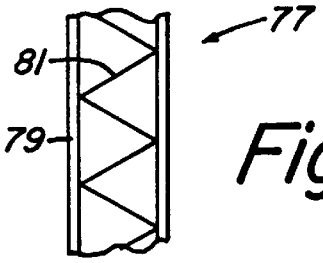
FIG. 10 is an alternate embodiment of a support column for use with the utility tower of FIGS. 1A and 1B.

FIG. 10 shows an alternate embodiment for a support column 29. In this embodiment, rather than a solid steel pipe, column 77 is made up of three or more legs 79 interconnected by lattice braces 81. Column 77 will extend through and be supported by tower 11 in the same manner as column 29.

To convert an existing utility tower 11 to one being able to support an antenna assembly 55, column 29 will be assembled in sections and erected within the enclosed interior of tower 11. Various tie braces 41, 43, 45, 47, 49 and 51 will be connected along the length to provide lateral support. The base 33 will be supported by a concrete foundation 37. The antenna assembly 55 will be mounted to the upper end and oriented by rotating the flanges 53 (FIG. 9). The wires 67 for the antennas 65 will drop through column 29 and pass out the port 71 at the lower end for connection to transmitting and receiving equipment. FIG. 11 shows one tower 11 having a column 29 installed and an adjacent tower 11 which is conventional.

The invention has significant advantages. The support column allows existing utility power transmission towers to be utilized for telecommunications without extensive modification. This avoids the need for numerous additional telecommunication towers. The support column also avoids the need for rebuilding an existing utility tower to provide the additional strength that would be needed to support an antenna. Adequate lateral strength already exists in the towers. The compressive loading of the antenna assembly is handled by the support column.

While the invention has been shown in only two of its forms, it should be apparent to those skilled in the art that it is not so limited, but is susceptible to various changes without departing from the scope of the invention.

I claim:

1. A method of supporting a telecommunication antenna assembly with an existing utility tower of an electrical power transmission system, the method comprising:

erecting an additional column with a lower end of the column supported by ground;

laterally supporting the column with the tower; and mounting the antenna proximate an upper end of said column, said antenna assembly laterally supported by said tower via said column.

2. The method according to claim 1 wherein the step of erecting the support column comprises extending an upper end of the column above the tower, and the step of mounting the antenna assembly comprises mounting the antenna assembly above the tower.

3. The method according to claim 1 wherein the step of mounting the antenna assembly comprises rotating the antenna assembly relative to the column to a desired orientation relative to the tower.

4. The method according to claim 1 wherein the utility tower has a framework comprising a plurality of legs anchored in ground and interconnected by lattice braces; and the step of erecting the support column comprises extending the support column within the framework of the utility tower.

5. The method according to claim 1 wherein the utility tower has a framework comprising a plurality of legs anchored in ground and interconnected by lattice braces; the step of erecting the support column comprises extending the support column through and above the framework of the utility tower; and the step of mounting the antenna assembly comprises mounting the antenna assembly to the column above the utility tower.

6. The method according to claim 1 wherein the utility tower has a longitudinal axis; and the step of erecting the support column comprises locating the column offset from and parallel to the longitudinal axis.

7. The method according to claim 1 further comprising:

connecting a waveguide wire to the antenna and extending the waveguide wire substantially to the ground through a passage provided in the column.

8. In an electrical power transmission system having a plurality of existing utility towers, each having a framework defined by a plurality of legs anchored in ground and interconnected by lattice braces, at least one crossarm extending transversely from the legs and supporting above the ground at least one electrical power wire extending from an adjacent one of the towers, an apparatus for transmitting telecommunication signals from at least one of the towers, comprising:

an additional column having a base supported by the ground adjacent to the legs;

an antenna assembly mounted proximate to an upper end of the column; and the column being secured to the tower, wherein the tower provides lateral support to the column.

9. The power transmission system according to claim 8 wherein the column has an interior passage and wherein at least one waveguide wire extends through the passage, leading from the antenna assembly substantially to the ground.

10. The power transmission system according to claim 8 wherein the column comprises a cylindrical pipe.

11. The power transmission system according to claim 8 wherein the tower has a longitudinal axis and the column is offset from and parallel to the longitudinal axis.

12. The power transmission system according to claim 8 wherein the column has an upper end which extends above the upper end of the tower, and the antenna assembly is mounted to the column above the tower.

13. The power transmission system according to claim 8 wherein the column extends within the framework of the tower.

* * * * *